US009751354B2

(12) United States Patent
Coombe

(10) Patent No.: US 9,751,354 B2
(45) Date of Patent: Sep. 5, 2017

(54) BINDING METHOD

(76) Inventor: Ron Coombe, Sydney (AU)

( * ) Notice: Subject to any disclaimer, the term of this patent is extended or adjusted under 35 U.S.C. 154(b) by 0 days.

(21) Appl. No.: 13/390,325

(22) PCT Filed: Aug. 11, 2010

(86) PCT No.: PCT/AU2010/001029
§ 371 (c)(1),
(2), (4) Date: May 1, 2012

(87) PCT Pub. No.: WO2011/017761
PCT Pub. Date: Feb. 17, 2011

(65) Prior Publication Data

US 2012/0313362 A1 Dec. 13, 2012

(30) Foreign Application Priority Data

Aug. 11, 2009 (AU) ..... 2009903741

(51) Int. Cl.
*B42D 3/00* (2006.01)
*B42D 1/02* (2006.01)
(Continued)

(52) U.S. Cl.
CPC ..... *B42B 2/00* (2013.01); *B42C 9/0056* (2013.01); *B42C 11/00* (2013.01); *B42D 1/02* (2013.01);
(Continued)

(58) Field of Classification Search
CPC ..... B42D 3/002; B42D 1/02; B42D 2/00
(Continued)

(56) References Cited

U.S. PATENT DOCUMENTS 2,014,305 A * 9/1935 Alger ..... 281/29
3,730,805 A * 5/1973 Heller, Jr. ..... 156/148
(Continued)

FOREIGN PATENT DOCUMENTS

BE WO 2007039804 A2 * 4/2007 ..... B42D 3/002
JP 03-112687 5/1991
(Continued)

OTHER PUBLICATIONS

International Searching Authority, International Search Report and Written Opinion for International Application No. PCT/AU2010/001029, Oct. 20, 2010, Oct. 20, 2010, 10 pages, Australian Patent Office, Australia.

(Continued)

*Primary Examiner* — Kyle Grabowski
(74) *Attorney, Agent, or Firm* — Alston & Bird LLP

(57) ABSTRACT

The present invention relates to a binding method for forming a book. The method includes the steps of: providing a cover (20) having front and back panels (22 and 24) which are joined by a spine panel (26); providing a book block (10) having front and back fly sheets (14 and 16); applying a first adhesive member (40) on a first part of the spine panel (26); applying a second adhesive member (42) on a second part of the spine panel (26); contacting the front fly sheet (14) with the front panel (22) in such a way that a margin of the front fly sheet (14) overlaps the first adhesive member (40); contacting the back fly sheet (16) with the back panel (24) in such a way that a margin of the back fly sheet (16) overlaps the second adhesive member (42); and pressing on the first and second parts of the spine panel (26) to bond the margin of the front fly sheet (22) to the front panel (22) and the margin of the back fly sheet (16) to the back panel (24), respectively.

20 Claims, 2 Drawing Sheets

(51) Int. Cl.

| | |
|---|---|
| ***B42B 2/00*** | (2006.01) |
| ***B42C 9/00*** | (2006.01) |
| ***B42C 11/00*** | (2006.01) |
| ***B42D 3/02*** | (2006.01) |

(52) U.S. Cl.
CPC ..... *B42D 3/00* (2013.01); *B42D 3/002* (2013.01); *B42D 3/02* (2013.01)

(58) Field of Classification Search
USPC ..... 412/4, 5, 19, 21, 28, 3, 17; 281/21.1, 29
See application file for complete search history.

(56) References Cited

U.S. PATENT DOCUMENTS

| | | | | |
|---|---|---|---|---|
| 3,870,344 | A | 3/1975 | Heller, Jr. et al. | |
| 4,496,617 | A * | 1/1985 | Parker | 428/55 |
| 4,800,110 | A * | 1/1989 | DuCorday | 428/43 |
| 5,011,187 | A * | 4/1991 | Hunder et al. | 281/21.1 |
| 5,062,754 | A * | 11/1991 | Bolin et al. | 412/4 |
| 5,203,590 | A * | 4/1993 | Ranson | 281/21.1 |
| 5,308,208 | A * | 5/1994 | Ranson | 412/5 |
| 5,779,423 | A * | 7/1998 | Bermingham | 412/4 |
| 6,174,120 | B1 * | 1/2001 | Kalisher | 412/1 |
| 6,250,867 | B1 * | 6/2001 | Gwyn | B42D 3/002 412/4 |
| 6,558,099 | B2 * | 5/2003 | Mendoza et al. | 412/1 |
| 6,685,415 | B2 * | 2/2004 | Rush et al. | 412/37 |
| 6,910,842 | B1 * | 6/2005 | Yeaple | 412/8 |
| 7,246,981 | B2 * | 7/2007 | Parker | 412/8 |
| 7,374,385 | B2 * | 5/2008 | Parker | 412/8 |
| 7,481,611 | B2 * | 1/2009 | Hoarau | 412/6 |
| 2004/0066030 | A1 * | 4/2004 | Parker | 281/21.1 |
| 2004/0119278 | A1 * | 6/2004 | VanDeWalle | B42D 3/002 281/21.1 |
| 2007/0216153 | A1 * | 9/2007 | Parker et al. | 281/21.1 |

FOREIGN PATENT DOCUMENTS

| | | |
|---|---|---|
| JP | 08-282150 | 10/1996 |
| WO | WO 97/21551 A1 | 6/1997 |
| WO | WO 2004/030927 | 4/2004 |
| WO | WO 2005/032844 | 4/2005 |

OTHER PUBLICATIONS

International Preliminary Examining Authority, International Preliminary Report on Patentability for International Application No. PCT/AU2010/001029, Jul. 12, 2011, 5 pages, Australian Patent Office, Australia.

* cited by examiner

BINDING METHOD

CROSS REFERENCE TO RELATED APPLICATIONS

This application is a National Stage Application, filed under 35 U.S.C. §371, of International Application No. PCT/AU2010/001029, filed Aug. 11, 2010, which claims priority to Australian Application No. 2009903741, filed Aug. 11, 2009; the contents of [both of] which are hereby incorporated by reference in their entirety.

TECHNICAL FIELD

This invention relates to a binding method suitable for binding printed matter. The invention relates particularly but not restricted to binding heavy paper such as gloss paper used for photos.

BACKGROUND OF THE INVENTION

It is generally desirable in the book binding industry to be able to bind loose sheets or printed matter in a secure as well as aesthetically pleasing manner.

Previous attempts to bind loose sheets or printed matter include the following:

1) using a stitching machine to drive heavy duty stables through the loose sheets and clinching them on the other side along the spine of a book; this method however has the disadvantage of leaving stitch marks on the sheets and/or cover;
2) using a U-shaped spring loaded channel to clamp the loose sheets together; this method has the shortcoming of the U-shaped channel being very visible and hence not aesthetically pleasing;
3) using melt adhesive to adhere front and back fly sheets to the cover respectively via a piece of mesh; this method has the shortcomings that a) the mesh requires expensive equipment to install; b) the melt adhesive does not function well on normal paper which is relatively porous.

It is an object of the present invention to provide a binding method which may overcome or ameliorate the foregoing disadvantage and shortcomings or which will at least provide a useful alternative.

DISCLOSURE OF THE INVENTION

According to one aspect of the present invention, there is provided a binding method for forming a book, the method including the steps of:

(1) providing a cover having front and back panels which are joined by a spine panel;
(2) providing a book block having front and back fly sheets;
(3) applying a first adhesive member on a first part of the spine panel;
(4) applying a second adhesive member on a second part of the spine panel;
(5) contacting the front fly sheet with the front panel in such a way that a margin of the front fly sheet overlaps the first adhesive member;
(6) contacting the back fly sheet with the back panel in such a way that a margin of the back fly sheet overlaps the second adhesive member; and (7) pressing on the first and second parts of the spine panel to bond the margin of the front fly sheet to the front panel and the margin of the back fly sheet to the back panel, respectively.

It should be noted that the method of the present invention need not be carried out in the order listed above or below.

The spine panel in a preferred embodiment includes a spine flanked by two hinge areas. Conveniently, the hinge areas are pliable. In a preferred embodiment, the method of the present invention includes the steps of laying and adhering the first and second adhesive members to the hinge areas, respectively.

Preferably, the method includes the step of juxtaposing the front, spine and back panels of the cover in an unfolded state on a plane. More preferably, step (5) includes the sub-steps of (5a) aligning one edge of the book block with the first adhesive member and (5b) placing the book block onto the front panel such that the margin of the front fly sheet makes contact with the first adhesive member.

Preferably, step (6) of the method includes the sub-steps of (6a) turning the back panel towards the book block, (6b) aligning a front edge of the back panel with a front edge of the front panel, and (6c) folding the back panel onto the back fly sheet.

It is preferred that the first adhesive member is located alongside the second adhesive member. The first and second adhesive members may lie parallel to each other. In a preferred embodiment, each of the first and second adhesive members is a strip of acrylic mass adhesive.

Preferably, each of the adhesive members has a thickness of substantially 0.05 mm. More preferably, each of the first and second adhesive members has a width of substantially 12 mm. Even more preferably, each adhesive member includes a backing material adapted to preserve the adhesive member until needed for use. The method is preferred to include the step of removing the backing material from each adhesive member.

It should be understood that the book block generally comprises a plurality of loose sheets being bound together. Although the present invention is most effective for binding heavy gloss paper such as that used for producing photo books, it may be used to bind all types of paper.

Preferably, the method includes the step of collating and aligning the loose sheets intermediate the front and back fly sheets to form a loose aligned pile. More preferably, the method includes the further step of using a wire or thread to securely stitch the loose pile together along an edge of the pile.

It is preferred that each of the fly sheets has a minimum thickness of 14 millimeters. Each fly sheet may be made of synthetic paper.

It is contemplated that the spine of the present invention may be configured so as to suit book blocks of various thicknesses. Preferably, the spine is chosen from one of three sizes, namely 5 mm, 8 mm and 12 mm. It is intended that the spine may be capable of accommodating a book block having a thickness smaller than itself.

According to another aspect of the present invention there is provided a bound book including:

a cover having front and back panels which are joined by a spine panel having first and second parts;
a book block having front and back fly sheets;
a first adhesive member attached to the first part of the spine panel;
a second adhesive member attached to the second part of the spine panel;

wherein a selected margin of the front fly sheet is attached to the front panel via the first adhesive member, and another selected margin of the back fly sheet is attached to the back panel via the second adhesive member.

BRIEF DESCRIPTION OF THE DRAWINGS

The invention may be better understood from the following non-limiting description of a preferred embodiment, in which.

DETAILED DESCRIPTION OF THE DRAWINGS

It should be noted that although the present invention is intended to be applied to bind heavy gloss paper such as that used for printing photos, it may be used to bind all types of paper.

Figure 1:
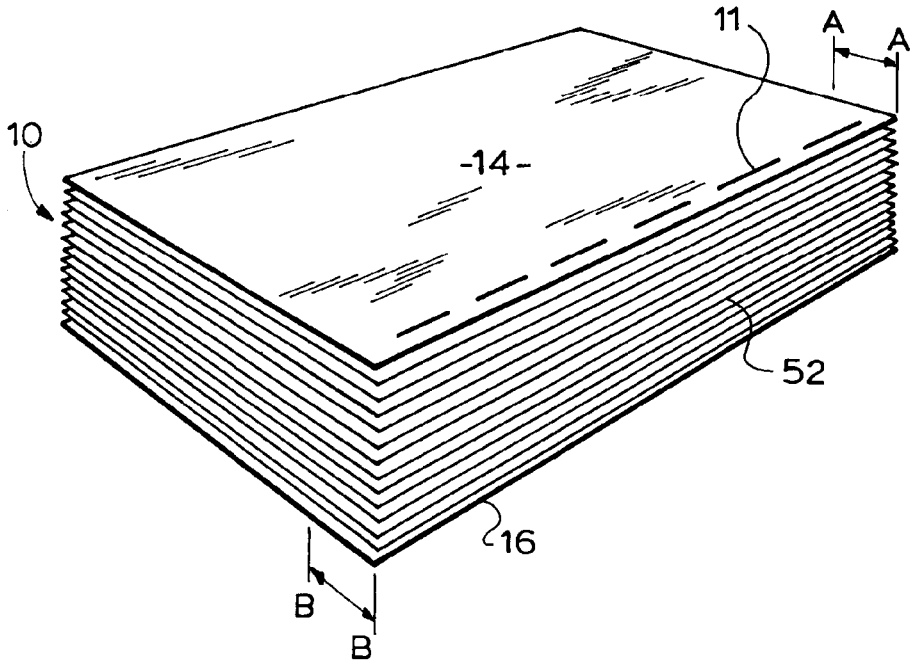
FIG. 1 is a perspective view of a book block adapted to be bound to a book cover by one embodiment of the present invention.

Referring to FIG. 1, a book block 10 comprises a plurality of loose sheets being bound together. Preparation of the book block 10 includes the initial steps of collating and aligning the loose sheets intermediate the front and back fly sheets 14 and 16 to form a loose aligned pile. A wire or thread 11 is then used to securely stitch the loose pile together via a stitching machine along spine edges 52 of the pile.

Figure 2:
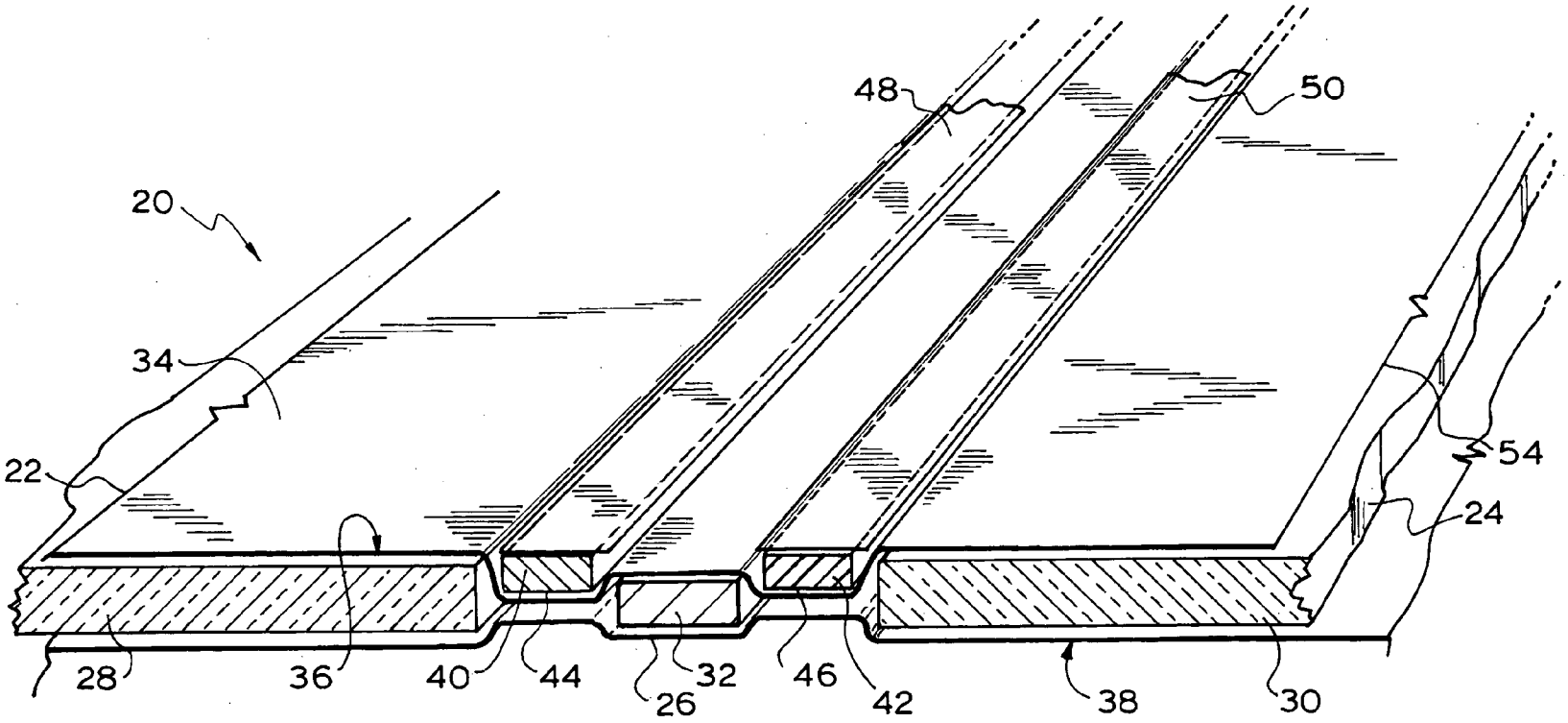
FIG. 2 is a perspective view of a book cover for binding the book block of FIG. 1, with adhesive members.

The book block 10 is to be bonded to a book cover 20 to form a book. Turning to FIG. 2, the book cover 20 has front and back panels 22 and 24 which are joined by a spine panel 26. The book cover 20 includes two cardboards 28 and 30 and a spine 32, all of which are within a case 34. In the present embodiment, the case 34 includes an inner layer made of a paper liner 36 and an outer layer made of a fabric 38.

The spine panel 26 includes a spine 32 flanked by two hinge areas 44 and 46 which are made of pliable material. The spine 32 is configured so as to suit book blocks of various thickness. It is contemplated that the spine 32 is provided in three sizes, namely 7 mm, 9 mm and 12 mm. The spine 32 is capable of accommodating a book block having a thickness smaller than itself. In the case of binding a book block that is substantially thinner than the spine 32, the spine 32 will bow outward to a certain degree upon completion of the binding process.

To enable bonding of the book block 10 to the cover 20, first and second adhesive members 40 and 42 are applied to the spine panel 26. Each of the adhesive members is a strip of acrylic mass adhesive having a thickness of substantially 0.05 mm and a width of substantially 12 mm. This involves having the cover 20 in an unfolded state with the front, spine and back panels 22, 26, and 24 respectively juxtaposed on a plane, and adhering the first and second adhesive members 40 and 42 onto the hinge areas 44 and 46, respectively. As shown in FIG. 2, the spine 32 is intermediate the first and second adhesive members 40 and 42 which lie alongside and are parallel to one another.

Each of the adhesive members 40 and 42 has a backing material 48, 50 which preserves the adhesive members 40 and 42. When needed for use, the backing material 48, 50 is peeled off each of the adhesive members 40 and 42. The removal of the backing materials 48 and 50 exposes the adhesive on the adhesive members 40 and 42 respectively and hence the next step should be carried out reasonably quickly.

Figure 3:
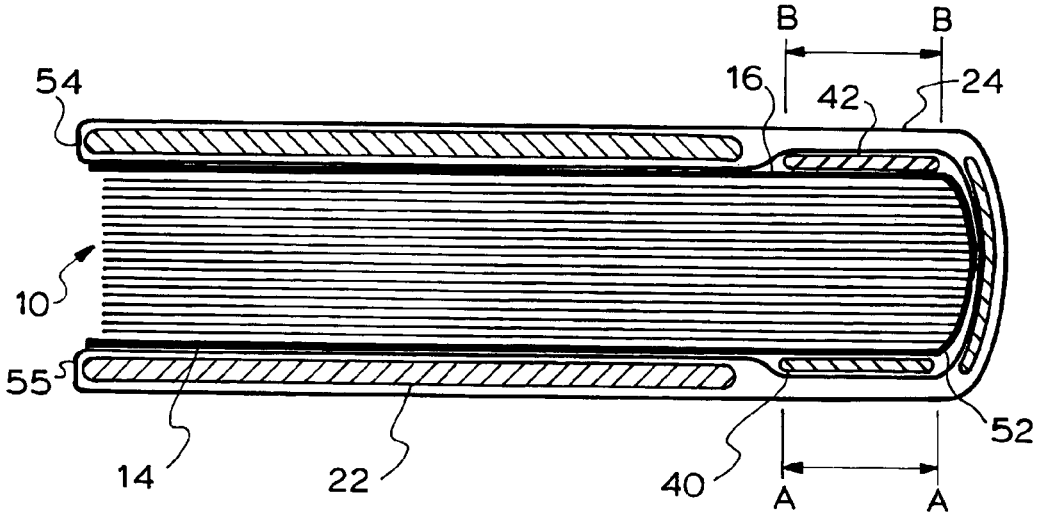
FIG. 3 is a side elevation of a bound book with the cover of FIG. 2.

Referring now to FIG. 3, the next step is to bring the front fly sheet 14 into contact with the front panel 22 in such a way that a margin of the front fly sheet 14 overlaps the first adhesive member 40. This involves aligning the edge 52 (refer back to FIG. 1) of the book block 10 with the first adhesive member 40 and placing the book block 10 onto the front panel 22 in such a way that the margin indicated by A-A (see FIG. 1) of the front fly sheet 14 makes contact with the first adhesive member 40. As this happens, the book block 10 is rested on top of the front panel 22.

To complete the binding process, the back fly sheet 16 is to be put into contact with the back panel 24 so that a margin indicated by B-B (refer FIG. 1) of the back fly sheet 16 overlaps the second adhesive member 42. This involves turning the back panel 24 towards the book block 10, aligning an edge 54 of the back panel 24 with an edge 55 of the front panel 22, and folding the back panel 24 onto the back fly sheet 16. To consolidate the bond between the adhesive members 40 and 42 and the respective fly sheets 14 and 16, the first and second parts of the spine panel 26 are to be pressed on firmly.

It should be noted that each of the front and back fly sheets 14 and 16 is made out of synthetic paper with a minimum thickness of 14 millimeters. This configuration can prevent the fly sheets 14 and 16 from being torn as a result of bearing the weight of the book block 10.

Now that a preferred embodiment of the present invention has been described in some detail, it will be apparent to a skilled person in the art that the binding method may offer at least the following advantages:

1. it is easy to apply enabling provision of a do-it-yourself type of service;
2. it produces a book which is aesthetically pleasing with no exposure of any binding components; and
3. it is economical to implement.

Those skilled in the art will appreciate that the invention described herein is susceptible to variations and modifications other than those specifically described. For example, the method of the present invention need not be carried out in a particular order. The book block may be adhered to the back panel first before bonding the front panel to the book block, as one variation. All such variations and modifications are to be considered within the scope and spirit of the present invention the nature of which is to be determined from the foregoing description.

INDUSTRIAL APPLICABILITY

The binding method of the present invention is industrially applicable in that it enables provision of a do-it-yourself type of service for the production of a book which is aesthetically pleasing without exposing the binding components.

The invention claimed is:

1. A binding method for forming a book, the method including the steps of:

(1) providing a cover having front and back panels which are joined by a spine panel having a spine flanked by separate first and second hinge areas, the front and back panels and the spine being enclosed within a case having an inner layer and an outer layer, the inner layer having a first surface facing and adjacent at least the spine, the separate first and second hinge areas being positioned adjacent a second surface of the inner layer, said second surface being opposite the first surface of the inner layer;

(2) providing a book block having front and back fly sheets;

(3) applying a first adhesive member on only the first hinge area of the spine panel and to an external surface of the inner layer of the case, such that the first adhesive member is external to the case;

(4) applying a second adhesive member on only the second hinge area of the spine panel and to an external surface of the inner layer of the case, such that the first adhesive member is external to the case;

(5) directly contacting the front fly sheet with the front panel and the first hinge area of the spine panel in such a way that only a margin of the front fly sheet comes into direct contact with the first adhesive member;

(6) directly contacting the back fly sheet with the back panel and the second hinge area of the spine panel in such a way that only a margin of the back fly sheet comes into direct contact with the second adhesive member; and (7) pressing on the first and second hinge areas of the spine panel to bond only the margin of the front fly sheet to the front panel and only the margin of the back fly sheet to the back panel, respectively.

2. The binding method of claim 1, wherein the hinge areas are pliable.

3. The binding method of claim 1, which includes the step of juxtaposing the front, spine and back panels of the cover in an unfolded state on a plane.

4. The binding method of claim 1, wherein step (5) includes the sub-steps of (5a) aligning one edge of the book block with the first adhesive member and (5b) placing the book block onto the front panel such that the margin of the front fly sheet makes contact with the first adhesive member.

5. The binding method of claim 1, wherein step (6) includes the sub-steps of (6a) turning the back panel towards the book block, (6b) aligning a front edge of the back panel with a front edge of the front panel, and (6c) folding the back panel onto the back fly sheet.

6. The binding method of claim 1, wherein the first adhesive member is located alongside the second adhesive member.

7. The binding method of claim 1, wherein the first and second adhesive members lie parallel to each other.

8. The binding method of claim 1, wherein each of the first and second adhesive members is a strip of acrylic mass adhesive.

9. The binding method of claim 1, wherein each of the first and second adhesive members has a thickness of substantially 0.05 mm.

10. The binding method of claim 1, wherein each of the first and second adhesive members has a width of substantially 12 mm.

11. The binding method of claim 1, which includes the step of providing a backing material for each adhesive member, the backing material being adapted to preserve the corresponding adhesive member until needed for use.

12. The binding method of claim 1, which includes the step of removing the backing material from each adhesive member immediately before use.

13. The binding method of claim 1, wherein the book block includes a plurality of loose sheets being bound together, each loose sheet being a piece of heavy gloss paper.

14. The binding method of claim 13, which includes the step of collating and aligning the loose sheets intermediate the front and back fly sheets to form a loose aligned pile.

15. The binding method of claim 14, which includes the further step of using a wire or thread to securely stitch the loose pile together along an edge of the pile.

16. The binding method of claim 1, wherein each of the fly sheets has a minimum thickness of substantially 14 millimeters.

17. The binding method of claim 1, wherein each fly sheet is made of synthetic paper.

18. The binding method of claim 1, which includes the step of providing the spine in at least one of the following three thicknesses: 5 mm, 8 mm and 12 mm.

19. A bound book comprising:

a cover having front and back panels which are joined by a spine panel having a spine flanked by first and second hinge areas, the front and back panels and the spine being enclosed within a case having an inner layer and an outer layer, the inner layer having a first surface facing and adjacent at least the spine, the first and second hinge areas being positioned adjacent a second surface of the inner layer, said second surface being opposite the first surface of the inner layer;

a book block having front and back fly sheets;

a first adhesive member directly attached to only the first hinge area of the spine panel and to an external surface of the inner layer of the case, such that the first adhesive member is external to the case;

a second adhesive member directly attached to only the second hinge area of the spine panel and to an external surface of the inner layer of the case, such that the first adhesive member is external to the case;

wherein only a selected margin of the front fly sheet is attached in direct contact to the front panel and the first hinge area via the first adhesive member, and only another selected margin of the back fly sheet is attached in direct contact to the back panel and the second hinge area via the second adhesive member.

20. A bound book produced by the binding method of claim 1.

* * * * *